US012281456B2

(12) United States Patent
Cai et al.

(10) Patent No.: US 12,281,456 B2
(45) Date of Patent: Apr. 22, 2025

(54) METHOD FOR FOUNDATION CONSOLIDATION COMBINING VACUUM PRELOADING AND GEOMEMBRANE BAG ASSEMBLY LOADING

(71) Applicants: Yuanqiang Cai, Wenzhou (CN); Jun Wang, Wenzhou (CN); Hongtao Fu, Wenzhou (CN); Shihu Gao, Wenzhou (CN); Bin Yang, Wenzhou (CN); Xiaoxiao Zhu, Wenzhou (CN); Rila Anda, Wenzhou (CN); Guohui Yuan, Wenzhou (CN)

(72) Inventors: Yuanqiang Cai, Wenzhou (CN); Jun Wang, Wenzhou (CN); Hongtao Fu, Wenzhou (CN); Shihu Gao, Wenzhou (CN); Bin Yang, Wenzhou (CN); Xiaoxiao Zhu, Wenzhou (CN); Rila Anda, Wenzhou (CN); Guohui Yuan, Wenzhou (CN)

(73) Assignee: Wenhou University, Wenzhou (CN)

( * ) Notice: Subject to any disclaimer, the term of this patent is extended or adjusted under 35 U.S.C. 154(b) by 0 days.

(21) Appl. No.: 17/725,569

(22) Filed: Apr. 21, 2022

(65) Prior Publication Data

US 2022/0341116 A1 Oct. 27, 2022

(51) Int. Cl.

| | |
|---|---|
| ***E02D 3/10*** | (2006.01) |
| ***E02D 3/12*** | (2006.01) |
| ***E02D 27/26*** | (2006.01) |

(52) U.S. Cl.

CPC ..... *E02D 3/10* (2013.01); *E02D 3/12* (2013.01); *E02D 27/26* (2013.01); *E02D 2250/0053* (2013.01)

(58) Field of Classification Search

CPC .. E02D 3/10; E02D 3/12; E02D 27/26; E02D 27/28

See application file for complete search history.

(56) References Cited

U.S. PATENT DOCUMENTS 10,294,621 B1 * 5/2019 Chen ..... E02D 3/10
11,377,377 B2 * 7/2022 Wang ..... C02F 1/463
(Continued)

FOREIGN PATENT DOCUMENTS

AU 2021101808 A4 * 6/2021
CN 104480956 A * 4/2015 ..... E02D 27/12
(Continued)

*Primary Examiner* — Frederick L Lagman

(57) ABSTRACT

A method for foundation consolidation combining vacuum preloading and geomembrane bag assembly loading, which comprises: digging a slurry pit, filling mud into the slurry pit and conducting vacuum preloading pumpdrainage for multiple times, laying the geomembrane bag assemblies above the soft slurry seam processed through vacuum preloading pumpdrainage inside the slurry pit to form a plurality of loading layers, and laying the geomembrane bag assemblies by piling geomembrane bags. In view of the engineering complexity and uneven settlement resulting from conventional vacuum preloading using slag loading, geomembrane bag for loading to overcome the adverse effects of slag loading. In the present invention, the drainage system and the geomembrane bag assemblies are laid out to fully leverage their perspective properties, so as to improve the transmission of vacuity in the whole soil mass, speed up the drainage rate, and increase the degree of consolidation.

9 Claims, 6 Drawing Sheets

(56) References Cited

U.S. PATENT DOCUMENTS

| | | | | |
|---|---|---|---|---|
| 2021/0156103 | A1* | 5/2021 | Sun | E02B 11/005 |
| 2021/0403351 | A1* | 12/2021 | Wang | B01D 35/06 |

FOREIGN PATENT DOCUMENTS

| | | | | | |
|---|---|---|---|---|---|
| CN | 105484229 | A | * | 4/2016 | |
| CN | 105780754 | A | * | 7/2016 | |
| CN | 109098169 | A | * | 12/2018 | E02D 3/10 |
| CN | 110424369 | A | * | 11/2019 | |
| CN | 110485436 | A | * | 11/2019 | E02D 17/18 |
| CN | 110924420 | A | * | 3/2020 | |
| CN | 111119156 | A | * | 5/2020 | |
| CN | 111335292 | A | * | 6/2020 | E02D 3/00 |
| CN | 111733792 | A | * | 10/2020 | |

* cited by examiner

METHOD FOR FOUNDATION CONSOLIDATION COMBINING VACUUM PRELOADING AND GEOMEMBRANE BAG ASSEMBLY LOADING

BACKGROUND OF INVENTION

1. Field of the Invention

The present invention relates to a method for foundation consolidation combining vacuum preloading and geomembrane bag assembly loading.

2. Description of Related Art

With rapid economic and social development as well as soaring population in coastal areas, the demand for land resources is becoming increasingly compelling. Therefore, tideland reclamation is becoming an important means of land resource development for many countries in the world. Generally, mud can be categorized into dredged mud, reclaimed silt and construction waste mud. These kinds of mud feature high water content, high compressibility, and low strength, and the soil mass is in the state of fluid and slurry. However, the conventional vacuum preloading method for foundation consolidation is of poor performance, and cannot meet the requirements for foundation strength and deformation in construction projects, and may often lead to engineering accidents.

Considering the engineering complexity and uneven settlement resulting from conventional vacuum preloading using slag loading, the present invention adopts geomembrane bags for loading to overcome the adverse effects of slag loading. At present, one kind of geomembrane bag treatment method is used quite widely, and can be directly used for loading above the slurry pit dug out in a construction project. Geomembrane bag is a kind of huge membrane bag and inclusion made of high-strength geotextile with its diameter changeable as needed. Geomembrane bags were initially used in embankment engineering, and then gradually applied in environment protection and agricultural fields. Currently, they are also applied in some sludge treatment projects. However, ordinary geomembrane bags have inherent defects in treating pipe mud and dredged mud: firstly, drainage is realized only through the natural settlement of mud and geomembrane bag stacking, and a long period of one to two months is required. The low speed and insufficient dehydration will obviously affect the duration of construction, and consequently lead to increased time cost and economic cost. Therefore, it is not suitable for urgent and complicated foundation consolidation projects; in addition, during the dehydration process through stacking and gravity-based squeezing of the geomembrane bags, the discharged water is very muddy and not immediately recyclable, and requires centralized treatment.

Furthermore, during the foundation consolidation process, the conventional vacuum preloading method has considerable loss of vacuity and low transmission efficiency along the depth, leading to poor treatment of in-depth soil mass and low bearing capacity of the foundation. From a microscopic view, because of the fine soil particles in the mud and the fluid state, during vacuum preloading, the soil particles are discharged along with the pore-water and are displaced. They gradually deposit around the drainage body to form a dense soil column, causing clogging and lower transverse permeability coefficient of the soil mass, and poor drainage and consolidation of the soil mass between drainage bodies; in addition, during the vacuum preloading pump drainage and consolidation process, the fine particles move along with the pore-water and enter the drain board filtering membrane, causing reduced permeability of the filtering membrane. The vacuum pumping generates a lateral pressing force upon the plastic drain board, forcing the filtering membrane into the drainage channel. Due to clogging of the filtering membrane, the vertical drainage flux of the drain board is reduced; the phenomena described above are collectively referred to as vacuum preloading clogging effect. Therefore, in view of the shortcoming of the conventional vacuum preloading, more researches need to be carried out to improve the current vacuum preloading method, and to improve the consolidation efficiency of vacuum preloading.

SUMMARY OF THE INVENTION

The object of the present invention is to provide a foundation consolidation method that uses the mud to be treated for loading (the material can be easily obtained), and adopts the technology of vacuum preloading for foundation consolidation, for better transmission of vacuity in the soft soil, higher drainage speed, and higher degree of consolidation.

A further step, said method comprising: a method for foundation consolidation combining vacuum preloading and geomembrane bag assembly loading, which comprises: digging a slurry pit, filling mud into the slurry pit and conducting vacuum preloading pump drainage for several times, place the geomembrane bag assemblies filled with mud above the soft slurry seam drained through vacuum preloading in the slurry pit to form a loading layer, the geomembrane bag assemblies are laid by stacking geomembrane bags.

More particularly, which comprises the following steps:

(1) prefabricate drainage systems and geomembrane bag assemblies for soft slurry seam vacuum preloading pump drainage;

(2) based on vacuum preloading method, fill multiple layers of mud on the soft slurry seam of the slurry pit, and place drainage systems layer by layer. After placement of the drainage systems on every layer, connect them to the vacuum pump assemblies, and start vacuum pumping;

(3) fill and stack the geomembrane bag assemblies;

(4) place second vertical drain boards around the slurry pit, place third transverse drain boards above the upper surface of the geomembrane bag assemblies, and connect the second vertical drain boards and third transverse drain boards to the vacuum pump assemblies for pump drainage.

More particularly, wherein a plurality of vertically arranged second horizontal drainage systems is placed into the soft slurry seam, the second horizontal drainage system includes a plurality of transversely arranged second transverse drain board, both sides of the second horizontal drainage system are respectively and conductively connected via elbows to the corresponding vertical drainpipes on both sides.

More particularly, wherein a plurality of vertical drainage systems is placed into the soft slurry seam; the vertical drainage system includes a plurality of first vertical drain boards, both sides of the first vertical drain board are respectively and conductively connected via elbows to the corresponding vertical drainpipes on both sides.

More particularly, wherein a vertical and horizontal integrated drainage system is placed into the soft slurry seam;

the vertical and horizontal integrated drainage system is a drainage system made of multiple rows of second transverse drain boards and multiple columns of first vertical drain boards, both sides of the second transverse drain board are connected with the adjacent first vertical drain boards, the first vertical drain boards are joined and connected to a transverse drainpipe.

More particularly, wherein the second horizontal drainage systems are covered by a geotextile layer, and are laid by the following means:

filling mud into the slurry pit, when the mud filled reaches the preset height, transversely place the firstly layer of second, horizontal drainage systems, and continue filling mud until it covers the geotextile layer of the second horizontal drainage systems, conductively connect the second junction blocks on both sides of the horizontal drainage systems of the first layer via elbows to the vertical drainpipes and start vacuum pumping immediately; repeat the above steps; as vacuum pumping goes on, the mud will sink simultaneously, when the covering mud reaches the standard height required by the construction project, lay the last layer of second horizontal drainage systems, and seal them using a second sealing membrane, so that the soft slurry seam of the slurry pit forms an integral body, and then conduct vacuum pumping.

More particularly, wherein the vertical drainage systems are covered using a geotextile layer, and are laid by the following means:

filling mud into the slurry pit, when the mud filled reaches the preset height, place the vertical drainage system at regular intervals, continue filling in mud until the mud completely covers the vertical drainage systems and reaches the standard height required by the construction project, and then stop filling; connect the vertical drainage systems to the vertical drainpipes in a conductive form, place a layer of second sealing membrane on the surface of the soft slurry seam, and start vacuum pumping.

More particularly, wherein the vertical and horizontal integrated drainage systems are laid by the following means:

filling mud into the soft slurry seam of the slurry pit, when the mud filled reaches the preset height, lay the vertical drainage systems at regular intervals, every time the mud filled reaches the preset height, place a layer of second transverse drain boards between every two vertical drainage systems, the second transverse drain boards are placed in the same direction as the vertical drainage systems; after placing every layer of second transverse drain boards, connect one end of the second transverse drain boards to the vertical drainpipes in a conductive form; repeat the above steps until the mud is filled to the standard height required by the construction project; place a layer of second sealing membrane on the soft slurry seam, finally, start the vacuum pump assemblies for vacuum preloading pump drainage, the vertical drainage systems and second transverse drain boards include the geotextile layer.

More particularly, wherein the geomembrane bag assemblies include sealing geomembrane bags and single geomembrane bags, first horizontal drainage systems are placed inside the sealing geomembrane bags, the first horizontal drainage systems are connected via the pipe system to the vacuum pump assemblies, wherein, sealing geomembrane bags are only laid on the topmost layer of the geomembrane bag assemblies.

More particularly, wherein, the inner wall and outer wall of the sealing geomembrane bags are configured with a first sealing membrane, the first horizontal drainage system includes first transverse drain boards and transverse geotextile to fix the first transverse drain boards, the transverse geotextile is transversely placed in the middle of the sealing geomembrane bag and divides the bag into an upper chamber and lower chamber; the first transverse drain boards are evenly fixed on the transverse geotextile at regular intervals; both ends of each first transverse drain board are connected via hand-type connectors to the pipe system, the first horizontal drainage systems are connected via geogrids to the two ends of the sealing geomembrane bags, the sealing geomembrane bag has a flange for the drainpipe to pass through, at least one end of the first transverse drain board is connected via the pipe system to the vacuum pump assemblies.

The benefits of the present invention are:

(1) By adopting a second horizontal drainage system, the vertical drainage system, and the layout of horizontal and vertical integrated drainage systems and the geomembrane bag assemblies in upper and lower layers, the respective properties of the two drainage systems are fully exploited, resulting in better vacuity transmission effect in the whole soil mass, quicker drainage speed, and higher degree of consolidation, so as to save time cost and economic cost.

(2) By using an integral second horizontal drainage system, an integral vertical drainage system or a horizontal and vertical integrated drainage system, the drain boards in every layer and every column can be maintained in the same plane, the overall structure is stable, and adverse effects resulting from bending or breakage of the drain boards can be avoided. Moreover, the layout is simplified, saving a lot of labor and cost.

(3) The drain board covered by the geotextile layer can have longer useful life, and can effectively reduce soil particles entering the drain board to cause clogging and reduced drainage speed.

(4) The second transverse drain boards and the first vertical drain boards are laid out in an intersecting manner to form a grid structure, thus improving the consolidation effect of the soil mass.

(5) The sealing geomembrane bag provided by the present invention is air-tight and fluid-tight, and is placed with the first horizontal drainage system. Such an arrangement can produce inside the sealing geomembrane bag a structure similar to vacuum preloading reclamation. During drainage of the first transverse drain board, a pressure difference is formed between the inside and outside of the sealing geomembrane bag, and the atmospheric pressure can press the sealing geomembrane bag to accelerate the drainage of the second transverse drain board, thus greatly saving time cost and economic cost. As the surface of the slurry pit is laid with a layer of sealing geomembrane bag assembly, the problem of low drainage efficiency with absence of external pressure can be effectively solved.

(6) The volume of the geomembrane bag can be adjusted as needed. It can have a wide application range, good engineering flexibility, and can be fabricated according to the size of the slurry pit; multiple layers of geomembrane bag assemblies can be continuously manufactured in factories to effectively save production cost; the geomembrane bag assemblies feature low investment, low human resource intensity, and easy and convenient operation.

(7) While using geomembrane bag assemblies to consolidate the sludge, the solid waste material can be used as filling materials to solve the problem of insufficient ground elevation, saving the transportation and material cost of additional filling materials like sand and stone.

DETAILED DESCRIPTION OF THE INVENTION

Detailed descriptions of the present invention are provided below with reference to the accompanying figures.

Figure 1:
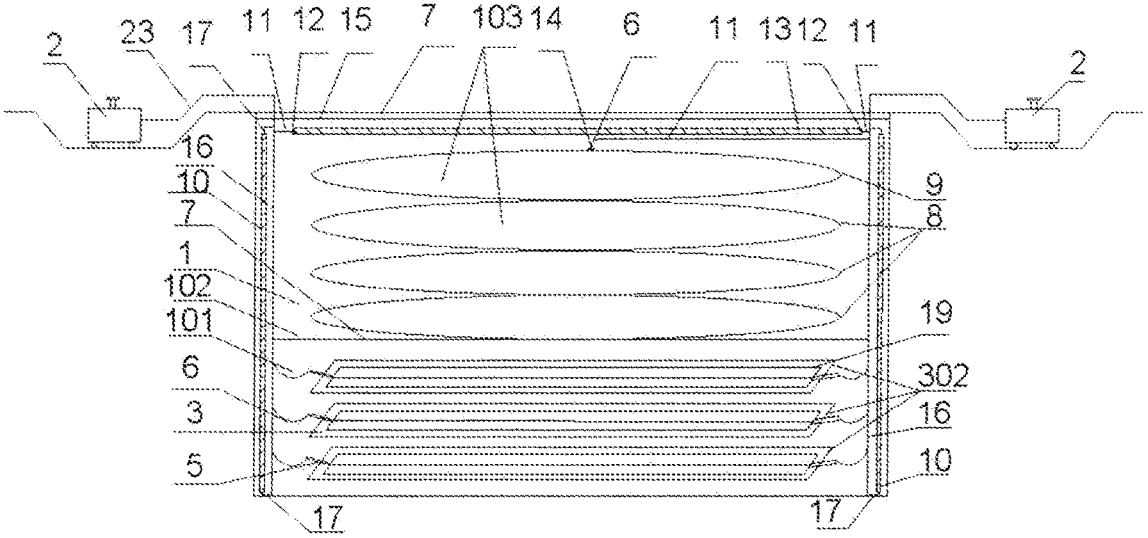
FIG. 1 is a schematic view of Embodiment 1 of the present invention.
Figure 2:
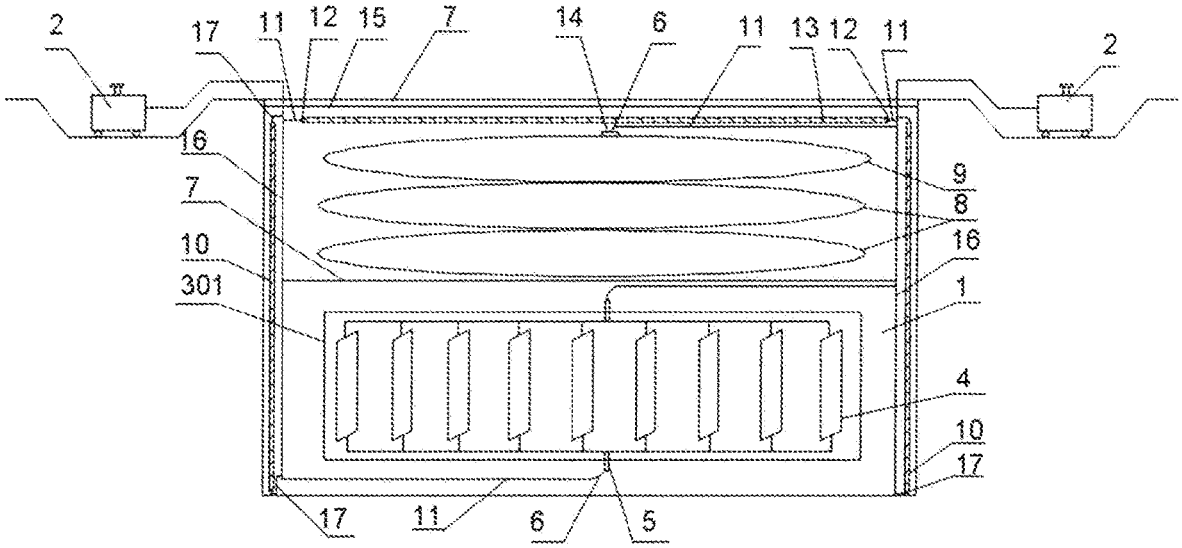
FIG. 2 is a schematic view of Embodiment 2 of the present invention.
Figure 3:
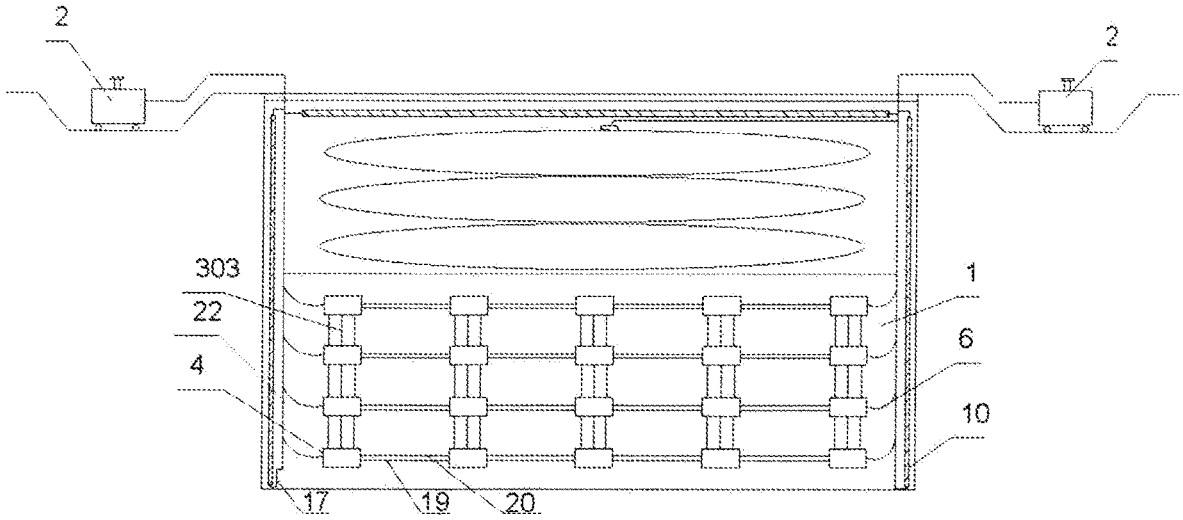
FIG. 3 is a schematic view of Embodiment 3 of the present invention.

Referring to FIGS. 1 to 3, the present invention is a method for foundation consolidation combining vacuum preloading and geomembrane bag assembly loading, comprising: digging a slurry pit 1, filling mud 22 into the slurry pit 1 and conducting vacuum preloading pump drainage for several times, laying the geomembrane bag assemblies 103 above the soft slurry seam 101 treated through vacuum preloading, pump drainage inside the slurry pit 1 to form a loading layer 102. Said geomembrane bag assemblies 103 are laid by stacking geomembrane bags. In the present embodiment, the slurry pit 1 dug out includes the soft slurry seam 101 and the loading layer 102 loaded above the soft slurry seam 101. Inside the soft slurry seam 101, drainage systems 3 connected to vacuum pump assemblies 2 are placed. In the present embodiment, the soft slurry seam 101 and the loading layer 102 are deployed in different layers. The soft slurry seam 101 is filled with dredged mud, reclaimed mud and construction waste mud etc. The drainage systems 3 are connected to the vacuum pump assemblies 2 through a pipe system 23. On the walls of the slurry pit 1 on both sides, drainpipes 16 are laid. The ends of each vertical drainpipe 16 on both sides are respectively connected to vacuum pump assemblies 2. The present invention uses the mud to be treated 22 as loading material. The pressure of the loading can be used for consolidation of the mud 22 inside the geomembrane bag assemblies 103. The consolidated geomembrane bags can be used as filling materials. The geomembrane bag assemblies 103 can be further used as the loading for the underlying soft slurry seam 101. The soft slurry seam 101 receives both vacuum suction force and loading pressure force at the same time. Thus, the efficiency of drainage and consolidation can be enhanced.

In the above descriptions, referring to FIGS. 1 to 3, 7, and 10, the geomembrane bag assemblies 103 include single geomembrane bags 8 and sealing geomembrane bags 9. The sealing geomembrane bags 9 are deployed on the topmost layer of the geomembrane bag assemblies 103. Single geomembrane bags 8 are geomembrane bags only filled with mud to be treated 22, and are drained by squeezing under loading/stacking. The sealing geomembrane bags 9 are configured with first horizontal drainage systems 18. The first horizontal drainage systems 18 are connected to vacuum pump assemblies 2 via pipe systems 23. In the present embodiment, the inner wall or outer wall of the sealing geomembrane bag 9 is provided with a layer of first sealing membrane 903. The first horizontal drainage system 18 includes a first transverse drain board 901, to fix the transverse geotextile 902 of the first transverse drain board 901. The transverse geotextile 902 is transversely placed in the middle of the sealing geomembrane bag 9 and divides it into an upper chamber and a lower chamber; Said first transverse drain boards 901 are evenly fixed on the transverse geotextile 902 at regular intervals; The two ends of the first transverse drain board 901 are connected to the pipe system 23 through hand-type connectors 12. Said first horizontal drainage system 18 is connected to both sides of the sealing geomembrane bag 9 through geogrids 20. After sealing, the sealing geomembrane bags 9 become airtight and fluidtight. At least one end of the first transverse drain board 901 is connected to the vacuum pump assemblies 2 via the pipe system 23; Through a flange 14, the sealing geomembrane hag 9 goes through the drainpipe to be communicated with the vertical drainpipes 16 on both sides. In the present invention, sealing geomembrane bags 9 are only deployed on the topmost layer of the geomembrane bag assemblies 103. It solves the problem of low drainage speed of the mud 22 in the geomembrane bags on the surface layer due to absence of external pressure. Meanwhile, the lower layers of geomembrane bag assemblies 103 use single geomembrane bags 8 to accelerate drainage through the load pressure, thus ensuring good efficiency of drainage and consolidation while saving cost and time.

Figure 11:
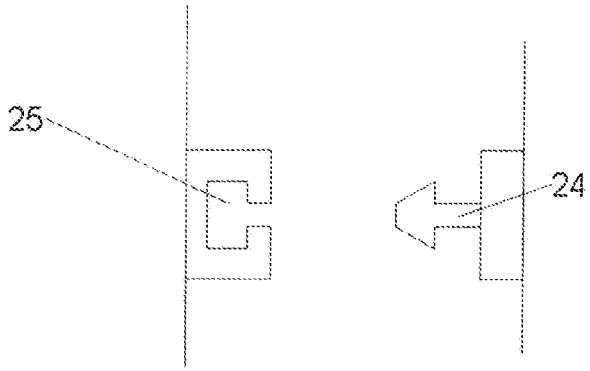
FIG. 11 is a schematic view of the locking slot and locking key of the geomembrane bag assembly.

In the above descriptions, referring to FIG. 11, one end of the single geomembrane bag 8 and the sealing geomembrane bag 9 is provided with a plurality of locking slots 25, whereas the other end is provided with locking keys 24 that match the locking slots 25. By linking the locking slots 25 with the locking keys 24, the geomembrane bag assemblies 103 can be connected to form an integral body.

Figure 4:
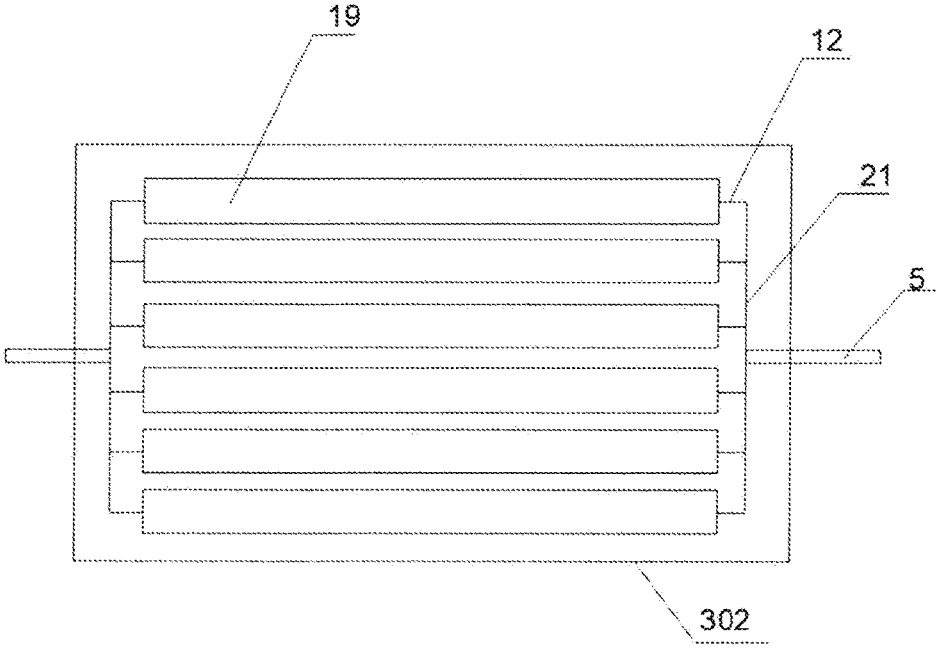
FIG. 4 is a schematic view of the plane layout of the second horizontal drainage system in FIG. 1.

In the above descriptions, drainage systems 3 is provided inside the soft slurry seam 101. In Embodiment 1, referring to FIGS. 1 and 4, inside the soft slurry seam 101, a plurality of vertically arranged second horizontal drainage systems 302 are deployed. The distances between all adjacent second horizontal drainage systems 302 are the same. In the present embodiment, the distance between the adjacent second horizontal drainage systems 302 is 40 cm. Each second horizontal drainage system 302 includes a plurality of transversely arranged second transverse drain boards 19, and the distance between the adjacent second transverse drain boards 19 is 80 cm. The second transverse drain boards 19 are fixed through iron wires. Both ends of the second transverse drain board 19 have a hand-type connector 12. The hand-type connectors 12 are sequentially connected and communicated with the first junction blocks 21 on both sides of the second transverse drain board 19. After collection, the first junction blocks 21 are connected to the corresponding second junction blocks 5. The upper lay and lower layer of the fixed second transverse drain boards 19 are laid with geotextile layers 15. The four sides of the upper and lower geotextile layers 15 are sealed and connected. One end of the second junction block 5 is placed inside the geotextile layer 15 and is communicated with the first junction block 21. The other end of the second junction block 5 extends out of the geotextile layer 15. The second junction block 5 is connected with the elbow 6. The elbow 6 is conductively connected with the vertical drainpipes 16 on both sides. The vertical drainpipes 16 on both sides are respectively connected to the vacuum pump assemblies 2.

Figure 5:
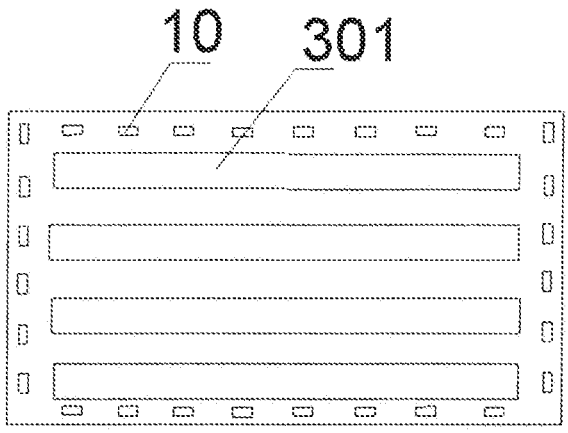
FIG. 5 is a schematic view of the plane layout of the vertical drainage system in FIG. 2.
Figure 6:
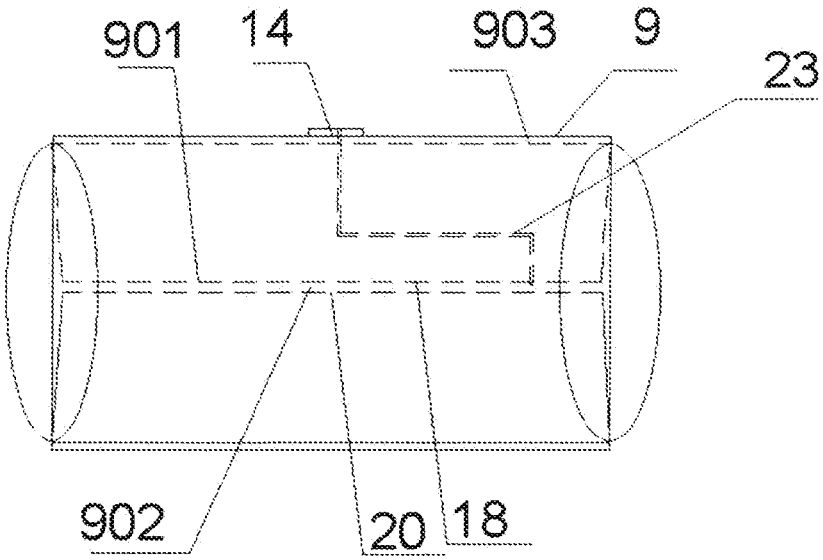
FIG. 6 is a perspective schematic view of the structure of the sealing geomembrane bag.
Figure 7:
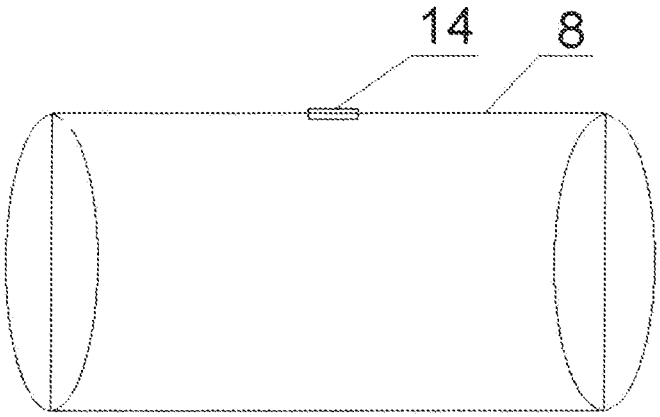
FIG. 7 is a perspective schematic view of the structure of a single geomembrane bag.
Figure 10:
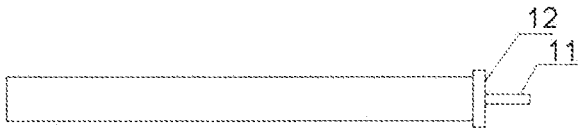
FIG. 10 is a schematic structural view showing the connection between the second transverse drain board and the hand-type connector.

Referring to FIGS. 2, 5 and 10, Embodiment 2 of the present invention is basically the same as Embodiment 1, with the only difference in that, inside the soft slurry seam 101, a plurality of vertical drainage systems 301 are laid vertically with a preset distance. In the present embodiment, the distance between the vertical drainage systems 301 is 40 cm. Each vertical drainage system 301 includes a plurality of first vertical drain boards 4. The first vertical drain boards 4 are arranged at equal intervals. The distance between the adjacent first vertical drain boards 4 is 80 cm. The first vertical drain boards 4 are fixed using iron wires. Both ends of the first vertical drain board 4 have hand-type connectors 12. The hand-type connectors 12 are sequentially conductively connected with the first junction blocks 21 on both sides of the first vertical drain board 4. The first junction blocks 21 are joined and connected to the corresponding second junction block 5. The upper layer and lower layer of the fixed first vertical drain boards 4 are laid with geotextile layers 15. The four sides of the geotextile on the upper layer and lower layer are sealed and connected to form a geotextile layer 15. One end of the second junction block 5 is placed inside the geotextile layer 15 and is communicated with the first junction block 21. The other end of the second junction block 5 extends out of the geotextile layer 15. The second junction block 5 is connected with the elbow 6. The elbow 6 is communicated with the vertical drainpipes 16 on both sides. The vertical drainpipes 16 on both sides are respectively connected to the vacuum pump assemblies 2.

Figure 8:
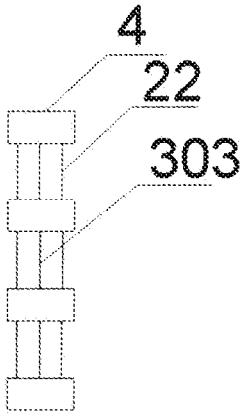
FIG. 8 is a schematic structural view of the layout of the first vertical drain boards in FIG. 3.
Figure 9:
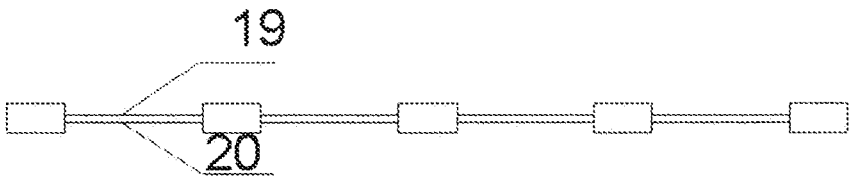
FIG. 9 is a schematic structural view of the layout of the second transverse drain boards in FIG. 3.

Referring to FIGS. 3, 8 and 9, Embodiment 3 of the present invention is basically the same as Embodiments 1 and 2, with the only difference in that, inside the soft slurry seam 101, horizontal and vertical integrated drainage systems 303 are deployed. The horizontal and vertical integrated drainage systems 303 are deployed with multiple rows of second transverse drain hoards 19 and multiple columns of first vertical drain boards 4 at preset intervals. In the present embodiment, the distance between the adjacent second transverse drain boards 19 is 40 cm, and the distance between the adjacent first vertical drain boards 4 is 80 cm. Both ends of the second transverse drain board 19 are connected to the adjacent first vertical drain boards 4. The vertical drain boards are joined and connected to a transverse drainpipe 11. The transverse drainpipe 11 is conductively connected with the vertical drainpipe 16 via the elbow 6, and the vertical drainpipe 16 is connected to the vacuum pump assemblies 2.

In the above descriptions of Embodiments 1, 2, and 3, all of the first vertical drain board 4, the second vertical drain board 10, the first transverse drain board 901, the second transverse drain board 19, and the third transverse drain board 13 include the geotextile layer 15 laid outside. Said first vertical drain board 4, second vertical drain board 10, first transverse drain board 901, second transverse drain board 19, third transverse drain board 13 are completely covered by the geotextile layer 15. The drainpipe can go through the geotextile layer 15. The drain boards covered by geotextile can have longer service life, and can effectively reduce particles entering the first vertical drain board 4, second vertical drain board 10, first transverse drain board 901, second transverse drain board 19, and third transverse drain board 13, causing reduced drainage speed. By adopting integral drainage systems 3, the second transverse drain boards 19 or first vertical drain boards 4 in every layer or every column can be always maintained in the same plane, and the whole structure is stable, thus avoiding adverse effects caused by bending or breakage. The simplified form of deployment can greatly reduce manpower and material resources.

Referring to FIGS. 1, 2 and 3, in Embodiments 1, 2, and 3 as described above, after laying the drainage systems 3 in the underlying soft slurry seam 101 of the lower-layer slurry pit 1, a second sealing membrane 7 is used for sealing before laying the loading layer 102.

Referring to FIGS. 1 to 5, in the above-described Embodiments 1, 2, and 3, a plurality of second vertical drain boards 10 are vertically inserted at the peripheral edges of the slurry pit 1. In the present embodiment, the distance between adjacent second vertical drain boards 10 is 100 cm. The outside of the second vertical drain boards 10 are covered by a geotextile layer 15. The end part of the second vertical drain board 10 is communicated with the third junction blocks 17. The third junction blocks 17 are sequentially communicated with the vertical drainpipe 16. The surface of the slurry pit 1, i.e., the upper surface of the sealing geomembrane bag 9 is laid with a plurality of third transverse drain boards 13 at regular intervals in between. In the present embodiment, the distance between the adjacent third transverse drain boards 13 is 100 cm. The outside of the third transverse drain boards 13 is covered by a geotextile layer 15. Both ends of the third transverse drain board 13 are conductively connected to the transverse drainpipe 11, so as to discharged the water squeezed out by the stacked geomembrane bag assemblies 103.

Part of the mud 22 in the soft slurry seam 101 beneath the slurry pit 1 will leak out during the pumping and consolidation, and the water naturally discharged from the single geomembrane bags 8 will be sucked and discharged through the second vertical drain boards 10 and the third transverse drain boards 13, so as to prevent leaking out from the periphery of the drainage systems 3 laid beneath to affect the drainage. The combination of single geomembrane bags 8, sealing geomembrane bags 9, drainage systems 3, third transverse drain boards 13 and second vertical drain boards 10 can greatly improve the drainage and consolidation effects.

In the above embodiment, the method for foundation consolidation combining vacuum preloading and loading according to the present invention includes:

(1) Prefabricating Drainage Systems 3 and Sealing Geomembrane Bags 9

Prefabricate second horizontal drainage systems 302, and arrange a plurality of second transverse drain boards 19 at regular intervals and fix them. The distance between adjacent second transverse drain boards 19 is 80 cm. Both ends of the second transverse drain board 19 are connected with hand-type connectors 12. The hand-type connectors 12 on the two sides are respectively conductively connected with the first junction blocks 21 on the two sides of the second transverse drain board 19. The first junction blocks 21 on the two sides are both connected with second junction blocks 5.

The upper layer and lower layer of the arranged and fixed second transverse drain boards 19 are both laid with geotextile layers 15. The four sides of the upper and lower geotextile layers 15 are sealed and connected. One end of the second junction block 5 is placed inside the geotextile layer 15 and conductively connected with the first junction block 21, while the other side of the second junction block 5 extends out of the geotextile layer 15; and/or Prefabricated the vertical drainage systems 3, and arrange a plurality of first vertical drain boards 4 at regular intervals and fix them. The distance between the adjacent first vertical drain boards 4 is 80 cm. The two ends of the first vertical drain board 4 are connected with hand-type connectors 12. The hand-type connectors 12 on the two sides are respectively and sequentially and conductively connected with the first junction blocks 21 on the two sides of the first vertical drain board 4. The first junction blocks 21 on the two sides are both conductively connected with second junction blocks 5. The upper and lower layers of the arranged and fixed first vertical drain boards 4 are both laid with geotextile layers 15. The four sides of the upper and lower geotextile layers 15 are sealed and connected. One end of the second junction block 5 is placed inside the geotextile layer 15 and is conductively connected with the first junction block 21, while the other end of the second junction block 5 extends out of the geotextile layer 15;

When prefabricating the drainage system 3, a geogrid 20 can be used to fix the first horizontal drainage system 18 in the middle position of the sealing geomembrane bag 9. Install the flange 14 on the upper surface of the sealing geomembrane bag 9, and conduct processing and sealing according to required specifications to form a completely sealed integral body. Thus the fabrication of the sealing geomembrane bag 9 is completed;

(2) Laying Drainage System 3

Filling mud 22 into the slurry pit 1, when the height of the mud 22 filled reaches 40 cm, transversely lay the first layer of second horizontal drainage systems 302, then continue filling in mud 22; when the mud 22 covers the geotextile layer 15 of second horizontal drainage systems 302 of the first layer, connect the second junction blocks 5 on both sides of the first layer of second horizontal drainage system 302 with the vertical drainpipe 16 via the elbows 6, and immediately conduct pumping. Meanwhile, continue filling mud 22 into the slurry pit 1; when the height of the second layer of mud 22 reaches 40 cm, lay the second layer of second horizontal drainage systems 302; when the mud 22 covers the geotextile layer 15 of the second layer of second horizontal drainage systems 302, connect the second junction blocks 5 on both sides of the second layer of second horizontal drainage system 302 to the vertical drainpipe 16 via the elbow 6, and immediately conduct pumping; continue filling mud 22 into the slurry pit 1; repeat the above process; as vacuum pumping goes on, the mud 22 will descend simultaneously, until the mud 22 coverage reaches the standard height required by the construction project; then lay the last layer of second horizontal drainage systems 302, and cover the topmost layer of second sealing membrane 7 and seal it, so that the lower layer of the slurry pit 1 forms an integral body, and then conduct vacuum pumping again; vacuum pumping for the second horizontal drainage systems 302 laid in the lower layer is conducted at the initial stage of filling, thus drainage and consolidation of the lower-layer mud 22 are started as soon as possible, and the degree of consolidation of the whole slurry pit 1 is effectively enhanced; or Filling mud 22 into the slurry pit 1, when the height of the mud 22 filled reaches 40 cm, lay the vertical drainage systems 301 at regular intervals; then, continue filling in mud 22 until the mud 22 completely covers the vertical drainage systems 301 and reaches the standard height required by the construction project, and stop filling; connect the second junction block 5 inside the vertical drainage system 301 with the elbow 6; the elbow 6 is connected with the transverse drainpipe 11, the transverse drainpipe 11 is conductively connected with the vertical drainpipe 16, and the vertical drainpipes 16 are connected to the vacuum pump assemblies 2; place a layer of second sealing membrane 7 on the surface of the soft slurry seam 101, and start vacuum pumping; or filling mud 22 into the slurry pit 1, when the height of the mud 22 filled reaches 40 cm, lay the vertical drainage systems 301 at regular intervals; every time the height of the mud 22 filled reaches 40 cm, place a layer of second transverse drain boards 19 between each two layers of vertical drainage systems 301; the second transverse drain boards 19 are placed in the same direction as the vertical drainage systems 301; every time a layer of second transverse drain board 19 is placed, one end of the second transverse drain boards 19 is connected to the elbows 6; the elbows 6 are joined via a second junction block 5, which is connected to the third junction block 17; repeat the above steps until the mud 22 is filled to the standard height required by the construction project; place a layer of sealing membrane on the soft slurry seam 101, and start the vacuum pump assemblies 2 for vacuum preloading pump drainage;

(3) Layout of the Loading

Filling and pile the single geomembrane bags 8, and place a layer of sealing geomembrane bag 9 on the topmost layer of the stack, then connect the vacuum pump assemblies 2 for drainage;

(4) Place second vertical drain boards 10 and third transverse drain boards 13 around the slurry pit 1, and conduct pumping and drainage to discharge the marginal water with poor treatment effect in the bottom layer and the water discharged from the upper layer of geomembrane bags in the slurry pit 1. Thus the whole drainage process can be conducted steadily.

We claim:

1. A method for consolidating a foundation using vacuum preloading combined with a geomembrane bag device load, comprising:

excavating a sludge pond, filling the sludge pond with sludge, and performing a plurality of vacuum preloading and drainage treatments;

laying a geomembrane bag device filled with sludge on top of a soft mud layer in the sludge pond after the plurality of vacuum preloading and drainage treatments to form a load layer, wherein the geomembrane bag device is arranged in a stacked configuration;

prefabricating a drainage system and a geomembrane bag device for vacuum p reloading and drainage of the soft mud layer; using a vacuum preloading method to fill the soft mud layer in the sludge pond with a plurality of layers of sludge, and laying a drainage system for each layer sequentially; after the installation of each layer's drainage system is completed, connecting the drainage system to a vacuum pump device and immediately starting the vacuum extraction;

filling and stacking the geomembrane bag device;

laying a second vertical drainage board around the sludge pond, and laying a third horizontal drainage board on an upper surface of the geomembrane bag device; the second vertical drainage board and the third horizontal drainage board are connected to the vacuum pump device for vacuum extraction and drainage.

2. The method for consolidating the foundation using vacuum preloading combined with the geomembrane bag device A load according to claim 1, wherein a plurality of vertically arranged second horizontal drainage systems is placed into the soft slurry seam, said second horizontal drainage system includes a plurality of transversely arranged second transverse drain board, both sides of the second horizontal drainage system are respectively and conductively connected via elbows to the corresponding vertical drainpipes on both sides.

3. The method for consolidating the foundation using vacuum preloading combined with the geomembrane bag device load according to claim 2, wherein the second horizontal drainage system is wrapped with a geotextile layer and is laid using the following steps:

filling the sludge pond with sludge, and when the sludge filling height reaches a predetermined level, laying a first layer of the second horizontal drainage system transversely;

continuing to fill the sludge until the geotextile layer of the second horizontal drainage system is covered;

connecting the second joint pipes at both ends of the first layer of the horizontal drainage system to the vertical drainage pipes through bent pipes and immediately starting vacuum extraction;

repeating the above steps, and as vacuum extraction is performed, the sludge settles synchronously, until the sludge covers the required engineering elevation;

laying the final layer of the second horizontal drainage system, and sealing with a second sealing membrane, thereby forming the soft mud layer in the sludge pond into an integrated structure, followed by vacuum extraction.

4. The method for consolidating the foundation using vacuum preloading combined with the geomembrane bag device load according to claim 1, wherein a plurality of vertical drainage systems is placed into the soft slurry seam; said vertical drainage system includes a plurality of first vertical drain boards, both sides of the first vertical drain board are respectively and conductively connected via elbows to the corresponding vertical drainpipes on both sides.

5. The method for consolidating the foundation using vacuum preloading combined with the geomembrane bag device load according to claim 4, wherein the vertical drainage system is wrapped with a geotextile layer and is laid using the following steps:

filling the sludge pond with sludge, and when the sludge filling, height reaches a predetermined level, laying the vertical drainage system at regular intervals;

continuing to fill the sludge until the vertical drainage system is completely covered and reaches the required engineering elevation, then stopping the filling;

connecting the vertical drainage system to the vertical drainage pipes, and laying a second sealing membrane on the surface of the soft mud layer;

starting vacuum extraction.

6. The method for consolidating the foundation using vacuum preloading combined with the geomembrane bag device load according to claim 1, wherein a vertical and horizontal integrated drainage system is placed into the soft mud layer; said vertical and horizontal integrated drainage system is a drainage system made of multiple rows of second transverse drain boards and multiple columns of first vertical drain boards, both sides of the second transverse drain board are connected with the adjacent first vertical drain boards, said first vertical drain boards are joined and connected to a transverse drainpipe.

7. The method for consolidating the foundation using vacuum preloading combined with the geomembrane bag device load according to claim 6, wherein said vertical and horizontal integrated drainage systems are laid by the following steps:

filling mud into the soft mud layer of the slurry pit, when the mud reaches a preset height, lay the vertical drainage systems at regular intervals, every time the mud filled reaches the preset height, place a layer of second transverse drain boards between every two vertical drainage systems, the second transverse drain boards are placed in the same direction as the vertical drainage systems; after placing every layer of second transverse drain boards, connect one end of the second transverse drain boards to the vertical drainpipes in a conductive form; repeat the above steps until the mud is filled to a standard height required by the construction project; place a layer of second sealing membrane on the soft slurry seam, finally, start the vacuum pump assemblies for vacuum preloading pump drainage, said vertical drainage systems and second transverse drain boards include the geotextile layer.

8. The method for consolidating the foundation using vacuum preloading combined with the geomembrane bag device load according to claim 1, wherein said geomembrane bag assemblies include sealing geomembrane bags and single geomembrane bags, first horizontal drainage systems are placed inside said sealing geomembrane bags, said first horizontal drainage systems are connected via the pipe system to the vacuum pump assemblies, wherein, sealing geomembrane bags are only laid on a topmost layer of the geomembrane bag assemblies.

9. The method for consolidating the foundation using vacuum preloading combined with the geomembrane bag device load according to claim 8, wherein, an inner wall and outer wall of the sealing geomembrane bags are configured with a first sealing membrane, said first horizontal drainage system includes first transverse drain boards and transverse geotextile to fix the first transverse drain boards, the transverse geotextile is transversely placed in the middle of the sealing geomembrane bag and divides the bag into an upper chamber and lower chamber; said first transverse drain boards are evenly fixed on the transverse geotextile at regular intervals; both ends of each first transverse drain board are connected via hand-type connectors to the pipe system, said first horizontal drainage systems are connected via geogrids to the two ends of the sealing geomembrane bags, said sealing geomembrane bag has a flange for the drainpipe to pass through, at least one end of the first transverse drain board is connected via the pipe system to the vacuum pump assemblies.

* * * * *